US011383265B2

(12) United States Patent
Rushe et al.

(10) Patent No.: US 11,383,265 B2
(45) Date of Patent: Jul. 12, 2022

(54) DEVICE FOR APPLYING ADHESIVE AND/OR SEALANT

(71) Applicant: Henkel AG & Co. KGaA, Duesseldorf (DE)

(72) Inventors: Peter Rushe, Duesseldorf (DE); Kai Ruthe-Steinsiek, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 108 days.

(21) Appl. No.: 15/999,219

(22) Filed: Aug. 17, 2018

(65) Prior Publication Data

US 2019/0001368 A1 Jan. 3, 2019

Related U.S. Application Data

(63) Continuation of application No. PCT/EP2017/053396, filed on Feb. 15, 2017.

(30) Foreign Application Priority Data

Feb. 18, 2016 (DE) ..... 102016202529.5

(51) Int. Cl.
*B05C 17/005* (2006.01)
*B65D 83/00* (2006.01)
(Continued)

(52) U.S. Cl.
CPC ..... *B05C 17/00596* (2013.01); *B05C 17/002* (2013.01); *B05C 17/00583* (2013.01);
(Continued)

(58) Field of Classification Search
CPC ..... B05C 17/00553; B05C 17/00583; B05C 17/00596; B05C 17/002; B65D 83/0055; B65D 47/20; B43M 11/06
(Continued)

(56) References Cited

U.S. PATENT DOCUMENTS 5,649,648 A 7/1997 Lier et al.
6,315,165 B1 * 11/2001 Regan ..... B65D 35/28 222/103
(Continued)

FOREIGN PATENT DOCUMENTS

CN 1084131 A 3/1994
CN 104768659 A 7/2015
(Continued)

OTHER PUBLICATIONS

International Search Report for International PCT Patent Application No. PCT/EP2017/053396 dated Apr. 25, 2017.

*Primary Examiner* — J C Jacyna
(74) *Attorney, Agent, or Firm* — James E. Piotrowski

(57) ABSTRACT

A device for applying adhesive and/or sealant having a housing for receiving a container, said housing having the following: a receiving chamber for receiving the container; a closable application tip which is connected to the receiving chamber and through which the adhesive and/or sealant can be discharged; a stable casing for the receiving chamber; at least one region of the housing which is in the form of a deformable pressure region and which allows pressure to be exerted from the outside onto the container which can be placed in the receiving chamber.

18 Claims, 3 Drawing Sheets

(51) Int. Cl.
*B05C 17/00* (2006.01)
*B43M 11/06* (2006.01)
*B65D 47/20* (2006.01)

(52) U.S. Cl.
CPC ..... *B43M 11/06* (2013.01); *B65D 83/0055* (2013.01); *B05C 17/00553* (2013.01); *B65D 47/20* (2013.01)

(58) Field of Classification Search
USPC ..... 222/485
See application file for complete search history.

(56) References Cited

U.S. PATENT DOCUMENTS 9,669,652 B2 * 6/2017 Kobayashi ..... B43M 11/06
2004/0112925 A1 * 6/2004 Py ..... B65D 35/06 222/494
2006/0054635 A1 * 3/2006 Iwahashi ..... B29C 45/1684 222/107
2007/0218229 A1 * 9/2007 Nagahama ..... B65D 35/28 428/35.7
2007/0267438 A1 * 11/2007 Wijerama ..... B05C 17/00583 222/101
2008/0058863 A1 * 3/2008 Quintero ..... B05C 17/00586 606/214
2008/0073372 A1 * 3/2008 Keller ..... A61J 1/2093 221/94
2009/0152296 A1 * 6/2009 May ..... B05C 17/00553 222/129
2009/0302058 A1 * 12/2009 D' Aguisto, II ..... B05C 17/005 222/103
2011/0253738 A1 * 10/2011 Mileti ..... B05B 11/00412 222/1
2012/0248145 A1 * 10/2012 Kealy ..... B65D 35/28 222/103
2014/0284352 A1 * 9/2014 Offermann ..... G03F 7/16 222/113
2016/0175878 A1 * 6/2016 Belanger ..... B05B 11/048 222/1
2017/0267413 A1 * 9/2017 Qian ..... B65D 35/56
2018/0200900 A1 * 7/2018 Eagleton ..... B26B 21/521
2019/0100356 A1 * 4/2019 Ruthe-Steinsiek .... B65D 35/56

FOREIGN PATENT DOCUMENTS

DE 3937299 A1 5/1991
DE 9107504 U1 9/1991
DE 4217593 C1 10/1993
EP 1445032 A2 8/2004
EP 2368812 A1 9/2011
JP H0848358 A 2/1996
JP 2007276879 A 10/2007
WO 9944904 A2 9/1999
WO 2013118582 A1 8/2013

* cited by examiner

Fig. 1
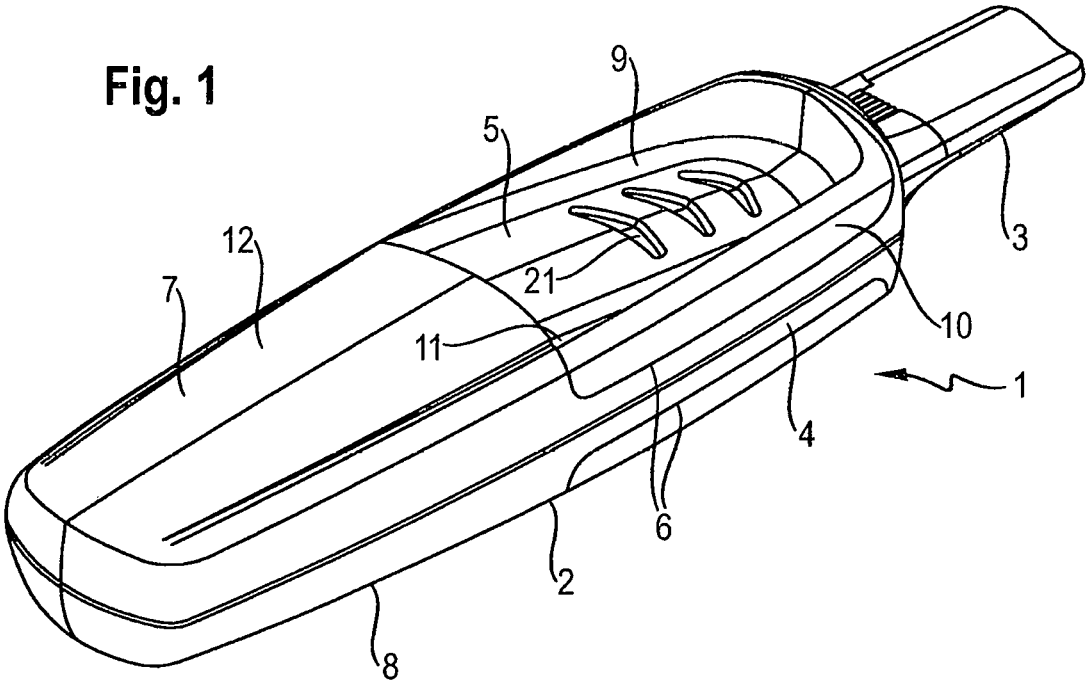
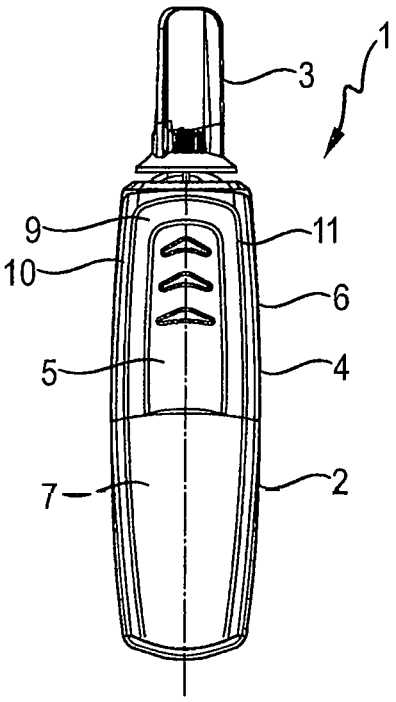
Fig. 2
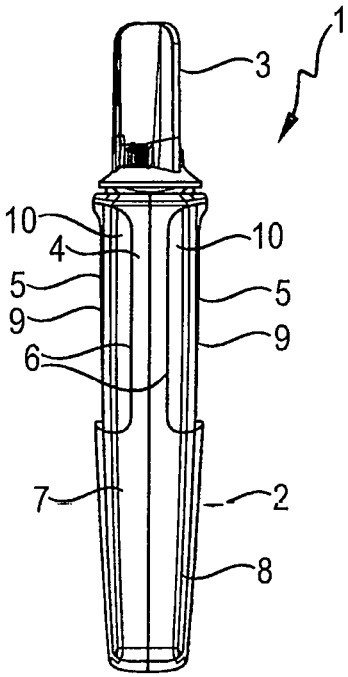
Fig. 3
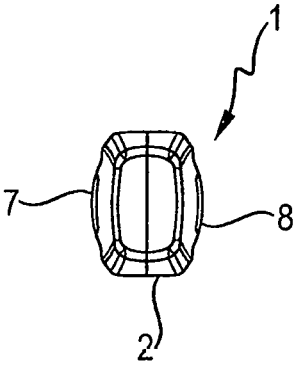
Fig. 4

DEVICE FOR APPLYING ADHESIVE AND/OR SEALANT

The present invention relates to a device for applying adhesive and/or sealant, comprising a housing for receiving a container containing the adhesive and/or sealant. A device of this kind is known, for example, from DE 39 37 299 A1.

An object of the present invention is that of providing a device for applying adhesive and/or sealant, which device comprises a housing for receiving a container containing the adhesive and/or sealant and is particularly easy to handle. In particular, the adhesive and/or sealant is intended to be dispensed particularly precisely and without much effort.

This object is achieved by the subject matter of the independent claim. Further embodiments are found in the dependent claims.

According to one aspect of the invention, a device for applying adhesive and/or sealant, which device comprises a housing for receiving a container containing the adhesive and/or sealant, is provided, the housing comprising a receiving space for receiving the container and a closable application tip which is connected to the receiving space and through which the adhesive and/or sealant can be discharged. The housing also comprises a stable casing for the receiving space, and at least one region of the housing which is designed as a deformable pressure region and which allows pressure to be exerted from the outside onto the container that can be arranged in the receiving space.

In this case, a container is understood to be a body which is filled with adhesive and/or sealant and can be inserted into the device. The device can be refilled by replacing the container. In this case, the container may be designed in particular as a cartridge or a tube, and may be made of a plastics material or a metal material, for example aluminum.

A stable casing is understood to be a casing which is not inherently deformable when the device is being used as intended. In particular, the stable casing is made of a material that will not deform during normal manipulation by a user but is instead made of a stiff material.

According to the invention, an optionally replaceable container is thus received in the housing, specifically in such a way that adhesive and/or sealant can be discharged from the container through the application tip of the device.

The discharge of the adhesive and/or sealant is caused by pressure on the container. For this purpose, a pressure region is provided in the otherwise stable, i.e. non-deformable, casing of the receiving space, which pressure region is deformable when manipulated by a user. The material in the pressure region can thus be deformed by a user exerting finger pressure onto the pressure region, and the pressure is transmitted to the container arranged therebelow in the receiving space.

The advantage of the device is that the container is securely received in the housing that is made, to the greatest possible extent, of a stable material, and yet it is possible to dispense adhesive and/or sealant particularly simply and precisely owing to the deformable pressure region. The device thus facilitates the application of adhesive and/or sealant. It also makes it possible to use a replaceable adhesive container and thus reduce waste.

According to one embodiment, the pressure region comprises a deformable, in particular elastic or elastomeric material, for example, rubber. The pressure region can, for example, be completely made of a deformable material. As a result, the pressure region itself gains a level of deformability during user manipulation which allows pressure to be exerted onto the container through the material of the pressure region.

Alternatively or additionally, the deformability of the pressure region can also be achieved by the pressure region comprising at least one movable region, which is separated from the remainder of the housing that surrounds it by a zone having increased deformability. In this case, the zone having increased deformability may be easily deformable such that pressure exerted onto the pressure region is transmitted to the container almost without loss.

A zone of increased deformability is understood to be a region that can be particularly easily deformed by user manipulation, in particular more easily deformed than regions adjacent thereto.

The zone having increased deformability can, for example, be formed by a region having lower material strength or by a material that can be more easily deformed, an easily deformable material being understood to be a material which requires lower forces to deform than are required for the remainder of the material of the pressure region. In one advantageous embodiment, when using an easily deformable material, the region having the easily deformable material is molded onto the adjacent region that is harder to deform. When using plastics materials for the two regions, this can be accomplished in particular by means of a bi-injection molding process.

A region having lower material strength means a region having a material strength that is lower than the material strength in regions that are directly adjacent to the region having lower material strength.

Alternatively or additionally, the zone having increased deformability can also be formed by the material of the pressure region in said zone being depressed, such that it is inverted when the movable region is pushed in and allows the movable region to move against the remainder of the housing that surrounds the movable region.

In this case, a depression of the material is understood to be an arrangement of the material in a small space, from which arrangement the material can be expanded to a greater dimension when the movable region is pressed in, without the material having to be deformed. An example of an arrangement of this kind is a bellows, in which it is also possible to provide just one single fold.

The advantage of embodiments of this kind of the zone having increased deformability is that they are suitable, individually or in combination with one another, for ensuring that the movable region has good mobility and thus for ensuring good transmission of force to the container.

According to one embodiment, the at least one pressure region comprises an upper face and a lower face, the upper face being exposed on the surface of the housing and the lower face facing a stable movable structure, which defines the receiving space below the at least one pressure region.

In this case, a stable movable structure is understood to be a structure which is inherently stable, i.e. not deformable, but which is mounted such that the entire structure can be moved. In particular, this can in this case be an elongated structure, one end of which is fastened to the stable casing or is integrally formed therewith, while the structure is otherwise free and therefore springs back under pressure on the free end thereof.

The advantage of the stable movable structure is that it allows force to be transmitted from the pressure region to the container particularly efficiently and uniformly. It also stabilizes the housing of the device. The embodiment of the stable moveable structure also allows the location of the force transmission to the container to be determined. It may therefore be possible, for example, for the adhesive and/or sealant to be pressed out from the closed end of the container, no matter at which location a user exerts the pressure onto the pressure region.

For this purpose, the stable movable structure can be arranged below the movable region and thus between the movable region and the container arranged in the receiving space. The movable structure can be in contact with both the container and the movable region.

According to one embodiment, the device comprises two pressure regions, which are formed on sides of the housing that are opposite to one another.

The advantage of this is that the orientation of the device does not matter when handling said device. Since the pressure regions are formed on two sides of the housing that are opposite to one another, the device can also be held such that it is rotated by 180 degrees. It is also possible to exert pressure onto the two pressure regions simultaneously, e.g. by having the thumb on one side and the forefinger on the opposite side.

According to one embodiment, the stable casing is made of a rigid material that will not deform when the device is held and used by a user. Rigid materials such as a hard plastic are particularly well suited to producing non-deformable portions of the housing, for example, by an injection molding process. Useful rigid materials include metal, acrylic polymer (PMMA), polyethylene, polypropylene, acrylonitrile butadiene styrene (ABS), polyamide (Nylon), polystyrene, polycarbonate, polyvinylchloride (PVC), polyetherimide (PEI), polyoxymethylene (POM), and combinations thereof, The deformable material may comprise a number of openings. These improve the feel of the surface in the pressure region by making it more difficult for the finger to slide off while handling the device. In addition, they visually emphasize the pressure region, which likewise contributes to better handling behavior, because the regions in which pressure is to be exerted in order to press out adhesive and/or sealant are more easily recognizable. For this purpose, the openings can be arranged in particular in the movable region of the pressure region.

According to one embodiment, the device comprises an extended grip region, which is formed by the housing extending in the longitudinal direction of the device over the receiving space for receiving the container.

This has the following advantage: To prevent adhesive and/or sealant from drying up during long periods of non-use, the container should not be too large. The volume of adhesive and/or sealant located therein should instead typically be used within a period of time within which the adhesive and/or sealant is unlikely to experience a loss of quality. The container may therefore advantageously be relatively short. However, for good handling behavior of the device, the length of the housing should not fall below a certain length, in order to ensure that the device can be held well and securely in the hand. For this purpose, the extended grip region is provided, which extends in the longitudinal direction of the device over the receiving space and thus is arranged on the end of the device which faces away from the application tip.

In this case, the extended grip region can be made of the same material as the stable casing. It is therefore stable and can be integrally formed with the stable casing.

According to one embodiment, a second container is also received in the housing. This may, for example, comprise a second component of the use of a two-component adhesive and/or sealant, the first container described at the outset containing the first component. The second container may also be a pen, for example for releasing an activation agent for the adhesive and/or sealant contained in the first container described at the outset. Furthermore, other design variants are of course conceivable. In particular, the second container may be used as a marker pen in the pen-like design. In the pen-like design, the container may be arranged in particular in an extended grip region of the device. For this purpose, the device may comprise a further application tip on the end thereof that is opposite the application tip for adhesive and/or sealant, on which end a tip of the second container is exposed.

The advantage of this embodiment is that the device can be used particularly versatilely. In particular, the otherwise unused space within the extended grip region could be used for a further container for example for releasing an activation agent.

BRIEF DESCRIPTION OF THE DRAWINGS

Embodiments of the invention are described in the following in greater detail with reference to schematic drawings, in which:

FIG. 1 is a perspective view of a device for applying adhesive according to a first embodiment of the invention;

FIG. 2 is a view from above of the device according to FIG. 1;

FIG. 3 is a side view of the device according to FIG. 1;

FIG. 4 is a view of the rear end of the device according to FIG. 1;

Figure 5:
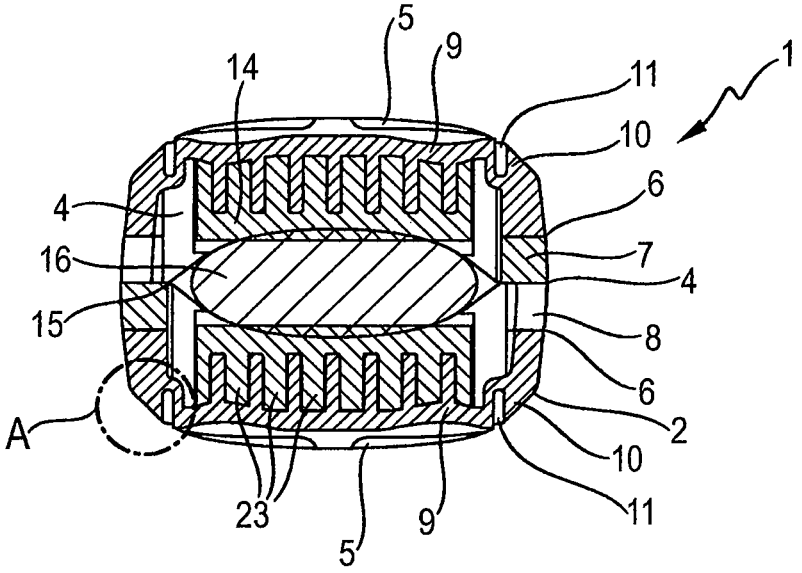
FIG. 5 is a cross-sectional view of the device according to FIG. 1.

The device 1 for applying adhesive according to FIG. 1 comprises a housing 2, which is made of hard plastics material. In the shown embodiment, a cyanoacrylate adhesive is used as the adhesive, which is commonly also known as instant glue or superglue. In principle, the depicted device can of course also be used for releasing a different adhesive or a sealant. An application tip for the adhesive, which tip can be closed by a closure cap 3, is arranged at one end of the housing 2.

The housing 2 comprises a stable casing 4 for a receiving space for receiving an adhesive cartridge or container for the adhesive. The stable casing 4 of the device 1 is formed of two largely identical half-shells, namely the first half-shell 7 and the second half-shell 8, which are interconnected to form the housing 2, for example by means of a snap connection which can be released in order to refill with adhesive.

A deformable pressure region 5 is formed in each of the two half-shells 7, 8. The pressure region 5 in this case comprises an outer region 10, which is connected in an edge region 6 to the stable casing 4. The pressure region 5 also comprises an inner region 9, which is arranged within the outer region 10. The inner region 9 is designed as a movable region.

In the embodiment shown in FIG. 1, the outer region 10 surrounds the inner region 9 on three sides.

Both the outer region 10 and the inner region 9 are made of a deformable material, in particular rubber. A number of openings 21 may optionally be formed in the inner region 9, which openings penetrate through some or all of the thickness of the deformable material of the inner region 9.

The inner region 9, as shown in FIG. 1, can be pressed inwards into the housing 2, the inner region already being pressed in regions into the housing in the shown embodiment. For this purpose, an inherently stable movable structure is provided under the material of the inner region 9 adjacent to the receiving space for the adhesive cartridge, onto which structure the deformable material of the inner region 9 is applied.

By exerting pressure onto the inner region 9, the movable structure (not shown in FIG. 1) is pressed into the housing 2, and thus exerts pressure onto the adhesive cartridge 16 that is located in the receiving space.

The inner region 9 is separated from the outer region 10 by a zone 11 of increased deformability. The zone 11 of increased deformability makes it easier to press in the movable structure by means of the inner region 9. This makes it possible to form a region that can be very easily moved, specifically the inner region 9 comprising the movable structure, in the per se closed housing 2, in which region pressure can be exerted in order to apply adhesive.

The housing 2 also comprises an extended grip region 12, which adjoins the side of the pressure region 5 that faces away from the application tip. A receiving space for an adhesive cartridge is not formed within the extended grip region 12.

FIGS. 2, 3 and 4 are further views of the device 1, it being particularly easy in FIGS. 3 and 4 to see in particular the formation of the housing 2 from two half-shells 7, 8, and the formation of a second, identical pressure region 5 on the opposite side to the first pressure region 5.

FIG. 5 shows the device according to FIGS. 1 to 4 in cross section, the section plane also extending through the receiving space.

In this drawing it can be seen that the first half-shell 7 and the second half-shell 8 form a receiving space 15 that is designed as a cavity, in which space the adhesive cartridge 16 is received. This can also be seen in the other sectional views in FIGS. 8 and 9.

The adhesive cartridge 16 is arranged in the receiving space 15 such that it is connected to an application tip 17 of the device 1. The adhesive cartridge 16 can in particular be made of a deformable plastic material or metal.

In the region of the receiving space 15, the first half-shell 7 and the second half-shell 8 are formed in part as the stable movable structure 14. For this purpose, as can be seen particularly well in FIG. 9, the end of the half-shells that is remote from the application tip 17 is rigidly connected to the remainder of the housing 2 of the device 1, while the half-shells comprise a free end 22 near the application tip 17. The inherently stable movable structure 14 can therefore be pressed into the receiving space 15 by means of pressure adjacent the free end 22. The pressure on the free end 22 is thereby transmitted to the adhesive cartridge 16, and in so doing adhesive can be pressed out from said adhesive cartridge 16 into the application tip 17.

In the shown embodiment, the stable movable structure 14 comprises a number of ribs 23, which simultaneously make the structure 14 stable and movable. Additionally, these ribs are used to improve the connection between the structure 14 and the elastic material of the pressure region 5.

To make it easier to press in the structure 14 in order to apply adhesive, the pressure region 5 made of elastic material is applied to the structure 14, which region forms a portion of the surface of the device 1.

Figure 6:
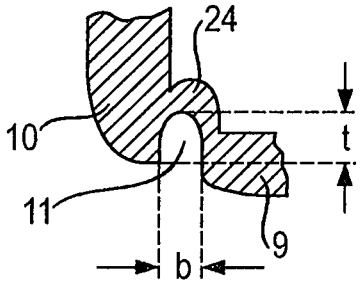
FIG. 6 shows a detail from FIG. 5.

In the detailed view of FIG. 6, it can be seen that the inner region 9 is separated from the outer region 10 of the pressure region 5 by a zone 11 of increased deformability. A u-shaped curved region 24 that has lower material strength is formed in the region of the zone 11, which curved region connects the inner region 9 to the outer region 10. FIG. 6 shows the u-shaped curved region 24 in a neutral position. The u-shaped curved region, like a bellows that has a single fold, enables the inner region 9 to be moved when pressure is exerted almost without resistance.

Figure 7:
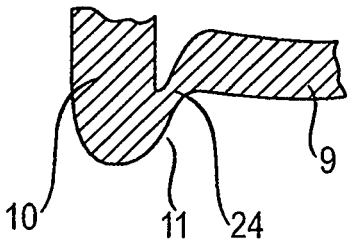
FIG. 7 shows the detail according to FIG. 6 when a force is being applied in order to press out adhesive.

To this end, FIG. 7 shows the situation in which the inner region 9 has been moved by the exertion of pressure. The u-shaped curved region 24 in FIG. 7 is displaced out of the neutral position and is extended and therefore inverted out of its folded or depressed position.

The u-shaped curved region 24, in the neutral position, causes the pressure region 5 to offer little resistance against being pressed in. The applied force is thus almost completely transmitted to the adhesive cartridge 16. Only a negligibly small proportion is expended on the deformation of the elastic material in the pressure region 5. This makes it possible to handle the device 1 with little effort and particularly precisely.

Figure 8:
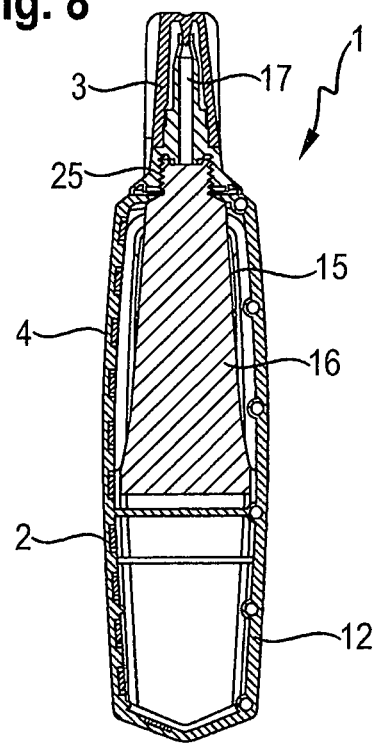
FIG. 8 is a first longitudinal sectional view of the device according to FIG. 1.
Figure 9:
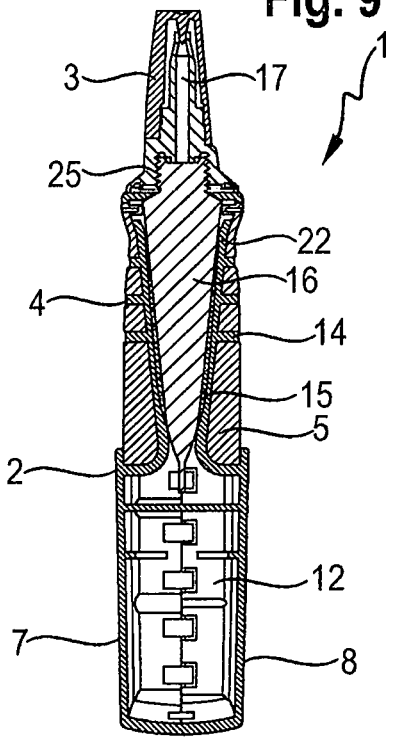
FIG. 9 is a second longitudinal sectional view of the device according to FIG. 1.

In the longitudinal section shown in FIGS. 8 and 9, it can be seen that the adhesive cartridge 16 in the receiving space 15 is connected to a component of the device that contains the application tip 17 by means of a threaded region 25. Here too, the application tip 17 is covered by the closure cap 3. In addition, the stable movable structure 14 and the free ends 22 of the two half-shells 7, 8 are visible in each case.

Figure 10:
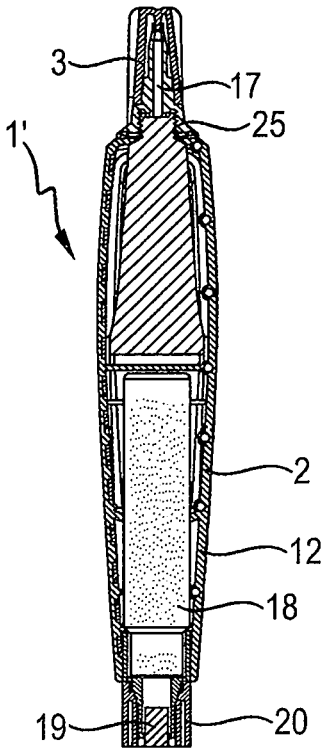
FIG. 10 is a longitudinal sectional view through a device for applying adhesive and/or sealant according to a second embodiment of the invention.
Figure 11:
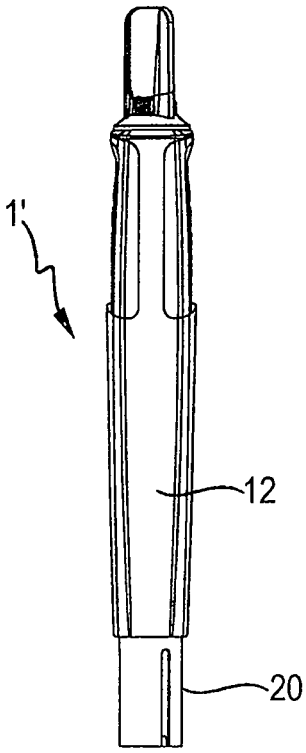
FIG. 11 is a side view of the device according to FIG. 10.
Figure 12:
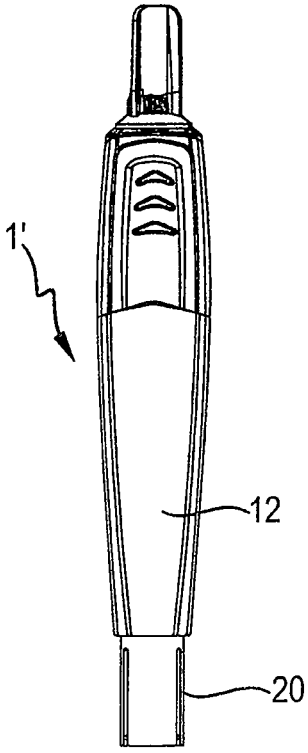
FIG. 12 is a view from above of the device according to FIG. 10.

FIGS. 10 to 12 are views of a device 1' for applying adhesive according to a second embodiment.

This differs from the first embodiment shown in FIGS. 1 to 9 only in that a second container 18, containing, for example, a marking pen or an activation agent for the adhesive, is arranged within the extended grip region 12, for which container a second application tip 19 and a closure cap 20 are provided on the other end of the device 1'.

LIST OF REFERENCE SIGNS

1, 1' Device
2 Housing
3 Closure cap
4 Stable casing
5 Pressure region
6 Edge region
7 First half-shell
8 Second half-shell
9 Inner region
10 Outer region
11 Zone of increased deformability
12 Extended grip region
14 Stable movable structure
15 Receiving space
16 Adhesive container or cartridge
17 Application tip
18 Second container

19 Second application tip
20 Closure cap
21 Opening
22 Free end
23 Rib
24 Curved region
25 Threaded region

The invention claimed is:

1. A device for applying adhesive and/or sealant, comprising:

a rigid housing for receiving a tapered container, wherein the housing has an application end, a longitudinally opposing extended grip region having an end and a medial portion positioned approximately midway between the application end and the extended grip region end, and the housing comprises:

a tapered receiving space defined within the rigid housing for receiving the tapered container so that a closed end of the container defines the medial portion position, wherein the receiving space is narrower adjacent the medial portion and wider adjacent the application end;

a closable application tip adjacent the application end which is connected to the receiving space and through which the adhesive and/or sealant can be discharged;

at least one region of the housing between the medial portion and the application end being a deformable pressure region having an outside surface, an opposing inside surface that can directly contact the container and at least one movable region which is connected adjacent the application end of the rigid housing by a zone having increased deformability, wherein the zone having increased deformability is formed by the material of the pressure region in said zone being depressed such that it is inverted when the movable region is pushed in and allows the movable region to move against the remainder of the housing that surrounds the movable region and pressure exerted on the outside surface forces the inside surface into contact with the container in the receiving space.

2. The device according to claim 1, wherein the pressure region comprises a deformable material connecting a periphery of the pressure region to the rigid housing.

3. The device according to claim 1, wherein the zone having increased deformability is an elastomeric material.

4. The device according to claim 1, wherein the zone having increased deformability comprises a material that can be more easily deformed.

5. The device according to claim 1, wherein the at least one pressure region comprises an upper face and a lower face, wherein the upper face is exposed on the surface of the housing and the lower face faces a stable movable structure which defines the receiving space below the at least one pressure region.

6. The device according to claim 1, wherein the tapered receiving space does not extend into the extended grip region.

7. The device according to claim 6, wherein the extended grip region is made of the same material as the rigid housing.

8. The device according to claim 6, wherein a second container is received in the extended grip region.

9. A device for a user to apply adhesive and/or sealant to a surface, including:

a rigid housing having an application end, an extended grip end longitudinally opposing the application end, a first side defining a pressure region near the application end, a grip region near the extended grip end, and a medial portion between the application end and the extended grip end, the pressure region having an exterior surface, an opposing interior surface and an elastomeric connection to the rigid housing, the pressure region being displaceable inwardly by the user from a neutral position toward a dispensing position, the grip region not being displaceable by the user, a second side opposing the first side, a third side connecting the first and second sides and a fourth side opposing the third side, the fourth side connecting the first and second sides, the housing sides defining a tapered internal cavity, the internal cavity having a receiving space adjacent the pressure region to hold a deformable container of adhesive and/or sealant having opposing tapered sides in direct contact with the interior surface of the pressure region, wherein a tapered side of the container is in direct contact with the interior surface of the pressure region, the receiving space having a connector for fluidly receiving adhesive and/or sealant from the deformable container, an applicator at the application end having an application tip and defining an internal conduit fluidly connecting the connector to the application tip;

wherein user movement of the pressure region inwardly from the neutral position toward the dispensing position presses the interior surface against the container of adhesive and/or sealant to displace adhesive and/or sealant through the connector and conduit to the application tip.

10. The device of claim 9 wherein the container is positionable in the receiving space by a user.

11. The device of claim 9 wherein the second side further comprises a pressure region near the application end and a grip region near the extended grip end, the pressure region having an exterior surface and an opposing interior surface and being deformable to allow the user to move the pressure region inward from a neutral position to a dispensing position where the interior surface is in direct contact with the container.

12. The device of claim 9 comprising a cap over the application tip and removably secured to the housing at the application end.

13. The device of claim 9 further comprising a second container disposed within the inner cavity adjacent the grip region, the second container fluidly connected to an application tip adjacent the grip end.

14. The device of claim 9 wherein the first side pressure region comprises an elastomeric material connecting a periphery of the pressure region to the rigid housing.

15. The device according to claim 1, wherein the tapered receiving space is formed by two transversely opposing arms, wherein the arms are spaced closer adjacent the medial portion and wider adjacent the application end and the arms do not contact each other.

16. The device of claim 9 wherein the tapered internal cavity region does not extend into the extended grip region and the tapered internal cavity is formed by two transversely opposing arms within the pressure region, wherein the arms are spaced closer adjacent the grip region and wider adjacent the application end and the arms do not contact each other.

17. The device of claim 9 wherein the elastomeric connection has an externally facing U shape in the neutral position.

18. The device of claim 9 wherein the elastomeric connection has an externally facing U shape in the neutral position and is inverted out of the U shape in the dispensing position.

* * * * *